US006401566B1

(12) United States Patent
Beale et al.

(10) Patent No.: US 6,401,566 B1
(45) Date of Patent: Jun. 11, 2002

(54) CONTROL LEVER HAVING ECCENTRICALLY MOUNTED RETURN SPRING

(75) Inventors: Robert S. Beale, Milwaukie; Jay D. Byler, Beaverton; Andrew J. Jaworksy, Portland, all of OR (US)

(73) Assignee: Williams Controls Industries, Inc., Portland, OR (US)

( * ) Notice: Subject to any disclaimer, the term of this patent is extended or adjusted under 35 U.S.C. 154(b) by 0 days.

(21) Appl. No.: 09/311,453

(22) Filed: May 13, 1999

(51) Int. Cl.[7] ..... G05G 1/14

(52) U.S. Cl. ..... 74/512; 74/513; 74/560; 474/112

(58) Field of Search ..... 74/512, 529, 523, 74/513, 560; 123/399; 474/112

(56) References Cited

U.S. PATENT DOCUMENTS 3,373,661 A * 3/1968 Reichard ..... 74/512 X
4,036,078 A * 7/1977 Muehling ..... 74/529
4,958,607 A * 9/1990 Lundberg ..... 123/399
5,241,936 A * 9/1993 Byler et al. ..... 123/399
5,396,870 A * 3/1995 Beale ..... 123/399
5,477,746 A * 12/1995 Perisho et al. ..... 74/512
5,533,420 A * 7/1996 Perisho ..... 74/512
5,759,125 A * 6/1998 Berg ..... 474/112

FOREIGN PATENT DOCUMENTS

DE G 8915641.2 * 10/1990 ..... 74/512

* cited by examiner

*Primary Examiner*—Vinh T. Luong
(74) *Attorney, Agent, or Firm*—Shoemaker and Mattare

(57) ABSTRACT

A control lever assembly in the form of a foot pedal includes a pedal arm pivotally mounted on a shaft supported on a base or bracket, and a helical spring for returning the arm to a home position. Lateral displacement of the spring during loading thereof is prevented through the use of either a mechanical stop engaging one side of the spring or eccentric mounting of the spring on relative to shaft.

4 Claims, 5 Drawing Sheets

CONTROL LEVER HAVING ECCENTRICALLY MOUNTED RETURN SPRING

TECHNICAL FIELD

The present invention broadly relates to manually operated control elements, such as levers and pedals, and deals more particularly with an arrangement for eccentric mounting of a lever return spring.

BACKGROUND OF THE INVENTION

Hand and foot operated control levers used in a variety of applications often employ spring loading to cause the lever to return to a starting or home position. In one typical configuration, the lever is pivotally mounted by a shaft carried on a stationary base or bracket, and the return spring is in the firm of a helical coil wrapped around and concentric with the shaft. The outer end of the coil spring is connected with the lever, while the opposite end of the spring is secured to the bracket, thus biasing the lever to move to its home position, but yieldable to the force applied by an operator to move to an intermediate or fully actuated position.

Concentric mounting of a coil spring in a control lever assembly of the type mentioned above results in several problems. First, because of the locations at which the opposite ends of the spring are loaded, the resultant forces applied to this spring tend to cause the spring to shift laterally in one direction away from the shaft. This lateral shifting of the spring when the lever is displaced causes uneven loading of the spring and related mounting components because the forces and resulting stresses are not evenly distributed. Consequently, components of the lever assembly are subject to premature failure.

Another adverse consequence of lateral shifting of the spring during lever operation is that adjacent coils of the spring often come in contact with each other, and as the lever continues to move during a stroke, the contacting coil segments rub against each other, causing spring wear. In applications where the control lever is subjected to heavy cycling, wearing of the spring in this manner can result in spring failure, in which case the control lever remains in its partially actuated state, rather than returning to its home position under the influence of the spring force.

One common application of a control lever of the type described above involves throttle controls, such as throttle control pedals used on vehicles where the pedal may be operated millions of cycles under heavy duty use typical of commercial vehicle applications. Certain of these throttle pedals, rather than being mechanically linked to vehicle's engine, rely on an electronic sensor mounted on the pedal to sense pedal position and deliver an electrical signal to the engine representative of such position. Return spring failure can be particularly serious in so called "electronic" throttle pedal applications since failure of the pedal to return to its home or idle position means that the vehicle engine continues to receive a throttle command signal somewhere between idle and wide open throttle. In the past, the only solution to reducing spring failure occasioned by rubbing of adjacent spring coils has been to lubricate the coils to reduce friction therebetween. Lubrication can be achieved by applying a Teflon coating to the spring. This Teflon coating, however, increases the cost of the pedal assembly, and even where effective, does not eliminate the problem of failure of the spring in other components due to the uneven loading of these components when the spring moves laterally during a pedal stroke.

Accordingly, there is a clear need in the art for an improved arrangement for mounting the coil spring in a manner which eliminates uneven distribution of spring loads and stresses, and avoids face-to-face contact of adjacent coils of the return spring. The present invention is directed toward satisfying this need.

SUMMARY OF THE INVENTION

According to one aspect of the invention, an improved arrangement for mounting a helically coiled return spring on the end of a control lever includes a spring mounting perch eccentrically mounted relative to a shaft that pivotally supports one end of the lever. The spring surrounds the shaft and has its inner and outer ends respectively secured to the perch and one end of the lever, thereby biasing the lever to a home or idle position. Eccentric positioning of the perch, and thus of the inner end of the spring, assures even spring load distribution and prevents coil-to-coil spring contact.

According to another aspect of the invention, a foot pedal control is provided, comprising: a pedal; a housing carried on one end of the pedal; a base; a helical return spring for returning the pedal to a home or idle position; a shaft mounting the pedal for rotation; means for connecting the spring between the base and the housing; and means for restraining the spring against lateral movement.

The restraining means preferably comprises a rib-like projection extending inwardly from an inside wall of the lever housing, and engagable with the outside coil of the spring to restrain the coil against lateral shifting during actuation of the pedal.

Accordingly, it is a primary object of the present invention to provide an improved arrangement for mounting a helical return spring on a control lever which assures even loading of the spring and related mounting components, while at the same time avoids coil-to-coil contact and resultant wear of the spring.

A further object of the invention is to provide an improved spring mounting arrangement as described above which eliminates the need for lubrication of the spring coils necessary to reduce frictional engagement therebetween.

A still further object of the present invention is to provide a return spring mounting arrangement of the type mentioned above which requires minimal modification of existing lever designs.

A still further object of the invention is to provide a foot pedal assembly having a return spring that exhibits increased service life and reduced component cost.

These, and further objects and advantages of the present invention will be made clear or will become apparent during the course of the following description of a preferred embodiment of the invention.

BRIEF DESCRIPTIONS OF THE DRAWINGS

In the drawings, which form an integral part of the specification and are to be read in conjunction therewith, and in which like reference numerals are employed to designate identical components in the various views.

DESCRIPTION OF THE PREFERRED EMBODIMENT

Figure 1:
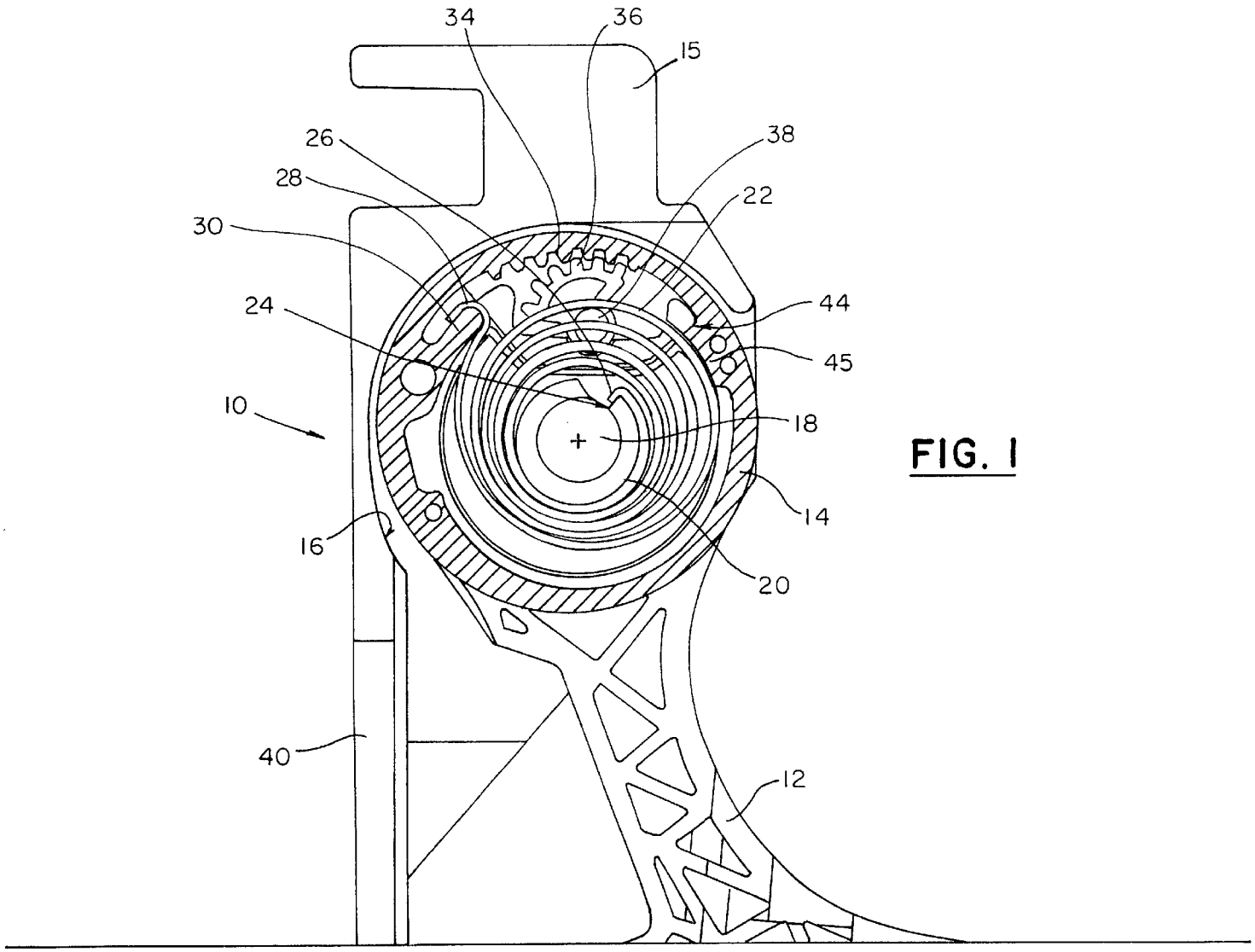
FIG. 1 is a fragmentary, cross sectional view of an electronic throttle pedal assembly employing the improved return spring mounting arrangement of the present invention, and depicting the pedal in its home, idle position.
Figure 2:
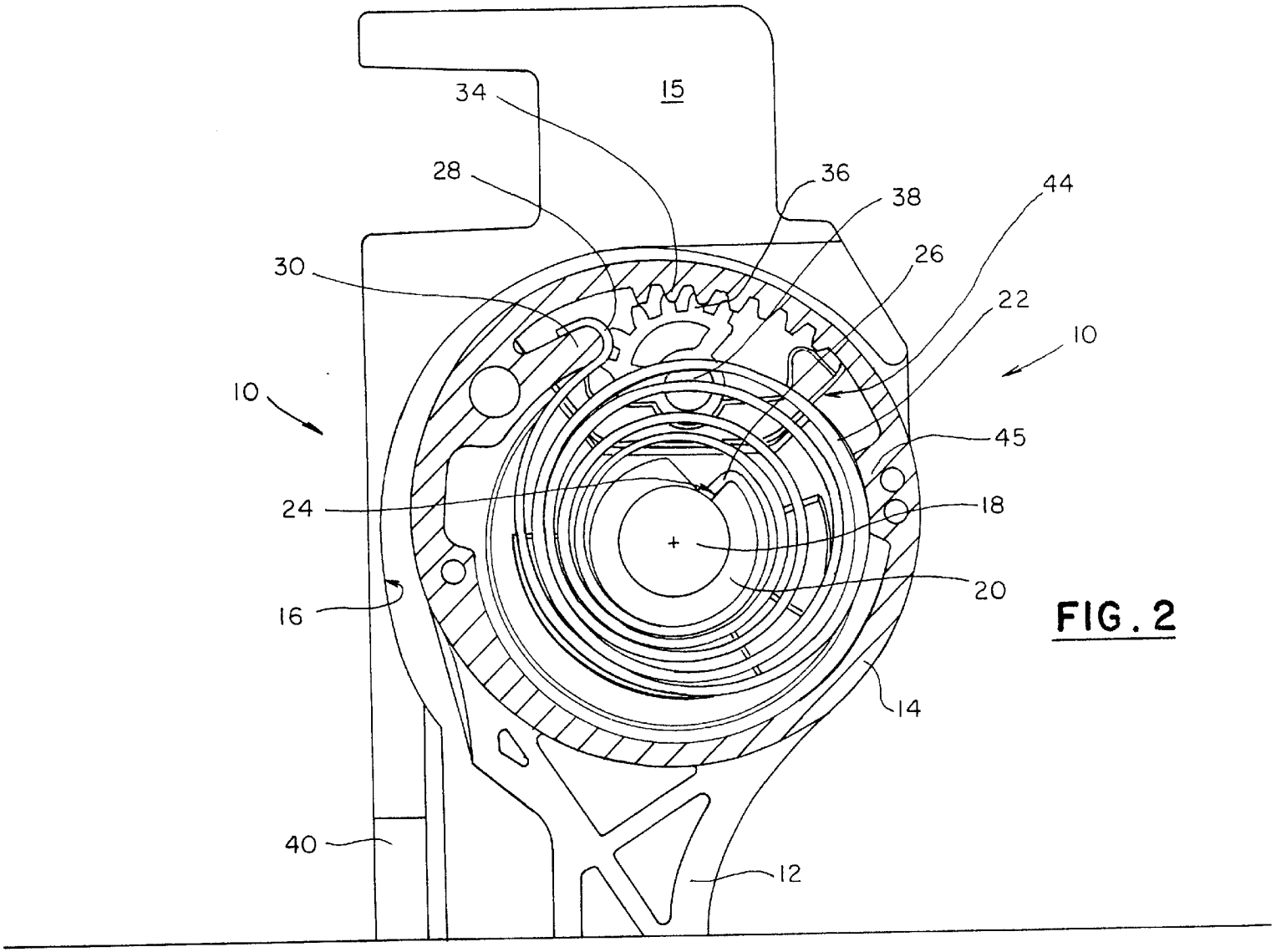
FIG. 2 is a view similar to FIG. 1, but showing the pedal in a partially displaced, actuated position.
Figure 5:
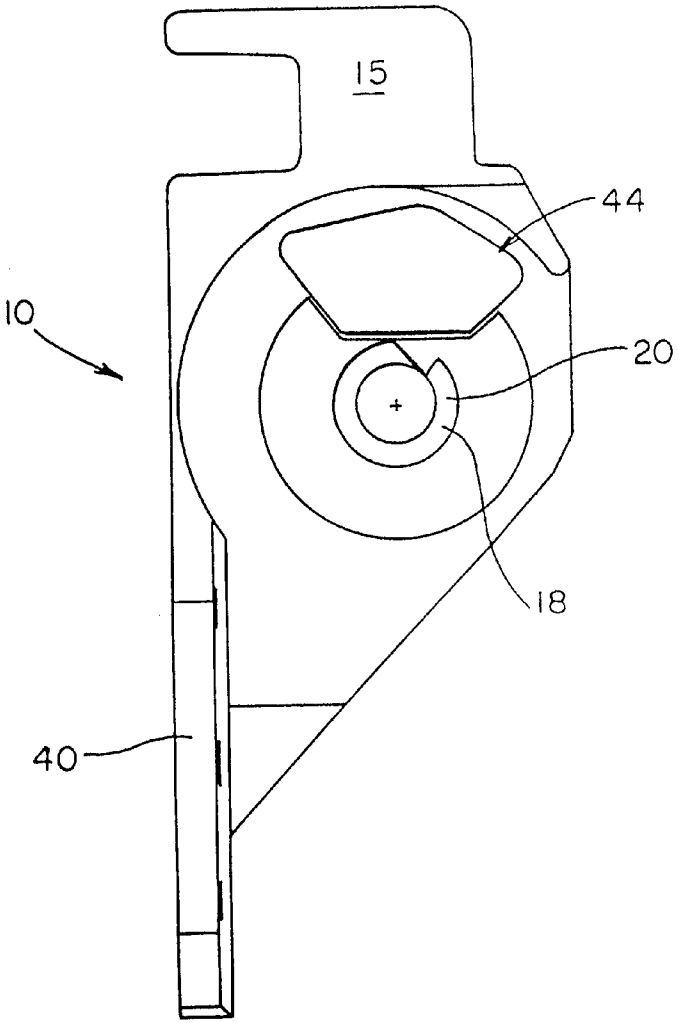
FIG. 5 is a view similar to FIG. 1, the spring and pedal arm having been removed for clarity.

Referring first to FIGS. 1, 2 and 5, the present invention relates to an improved arrangement for mounting a helically coiled return spring on one end of a control lever displaceable by an operator. In the illustrated embodiment, the lever comprises a foot operated, electronic throttle pedal assembly, generally indicated by the numeral 10. The pedal assembly 10 broadly includes a base or bracket 40 secured, as by bolts to the firewall (not shown) of a vehicle, and a pedal lever arm 12 suspended from the bracket 40. The bracket 40 possesses a forwardly extending wall 15. Pedal arm 12 has a foot treadle (not shown) secured to the lower end thereof, while the upper end of the lever arm 12 is provided with a cylindrically shaped, cup-like housing 14 that is received within an arcuate cut out 16 in the bracket 40. The cup housing 14 is preferably integrally formed with the lever arm 12, and may comprise a unitary plastic part formed in an injection molding operation. The cup housing 14 has a closed outer end, and an inner open end which faces the forwardly projecting wall 15 upon which the lever arm 12 is directly mounted by means of a shaft 18 which extends laterally outward from and is journalled for rotation on wall 15 by means of suitable bearings (not shown). The shaft 18 passes through a generally cylindrical spring perch 20 which extends perpendicularly outwardly from, and is preferably formed integral with the wall 15, and thus provides support for the shaft 18. The bracket 40 along with the wall 15 and perch 20 are desirably of a unitary construction formed, for example, as by die casting a metal such as aluminum. The shaft 18 and spring perch 20 are concentrically disposed with respect to each other and effectively mount the pedal lever 12 in a cantilever fashion on the wall 15.

A portion of the interior wall of the cup housing 14 includes a plurality of gear teeth 34 formed integrally therein which mesh with and drive a toothed gear segment 36. Gear segment 36 is mounted for rotation with a drive shaft 38 that is supported on and extends through wall 15. The outer end of drive shaft 38 is drivingly connected with an electronic rotary position sensor (not shown) of the type well known in the art, which outputs an electrical signal representative of the rotary position of the pedal lever 12. The bracket wall 15 includes a cut out segment 44 to provide clearance for the segment gear 36.

In order to return the pedal lever 12 to its home or idle position, a helically coiled clock-type spring is provided within the cup housing 14, in the annular space defined between the spring perch 20 and in the inside wall of the cup housing 14. The inner end of the spring 22 includes a first hooked portion 26 that is captured within and held by a notch 24 in the periphery of spring perch 20. The outer end of the spring 22 includes a second hooked portion 28 which is captured around a projection 30 integrally formed in the interior wall of the housing 14. From the immediately foregoing description, it may be appreciated that depression of the pedal lever 12 causes the housing 14 to rotate in a clockwise direction, thus likewise displacing the outer end of the spring, 22 clockwise, while the inner end thereof is held stationary by the spring perch 20. This rotational motion of the housing 14 loads the spring 22, causing the latter to bias the lever 12 back to its home or idle position. Because of the nature of the coil spring 22, and the manner in which it is mounted within the housing 14, loading of the spring 22 caused by clockwise displacement of the lever 12 produces reactive force components that urge the coils of the spring 22 laterally toward one side of the housing 14. This lateral displacement is due in part to the fact that the inner end of the spring 22 is restrained during the spring loading process. As discussed earlier, this lateral displacement of the spring 22 during the loading process results in uneven loading of the various components of the assembly, while at the same time causing adjacents coil segments of the spring 22 to engage each other, in turn causing friction and wear of the spring 22. In accordance with one aspect of the invention, a mechanical spring stop in the form of a raised area or rib 45 is provided on the inside face of the cup housing 14, at a circumferencial location in line with the direction of lateral displacement of the spring 22. The rib 45 effectively engages a short section of the outer coil on spring 22 during lateral displacement of the latter so as to effectively limit such lateral displacement to such a degree that loading of the components remains balanced and adjacent sections of the coils of the spring 22 are prevented from engaging each other.

Figure 3:
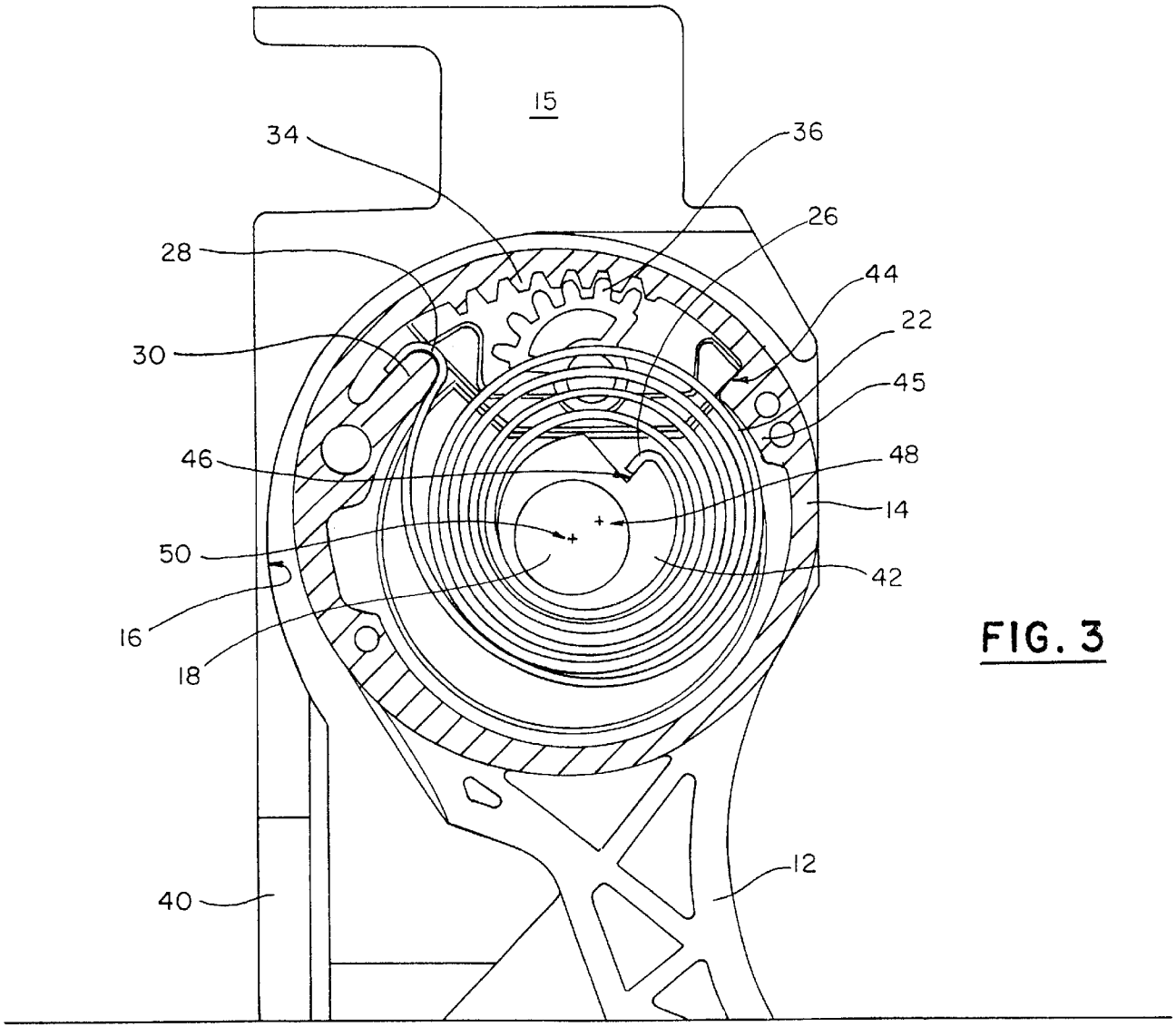
FIG. 3 is a view similar to FIG. 1, but depicting an alternate form of the invention.
Figure 4:
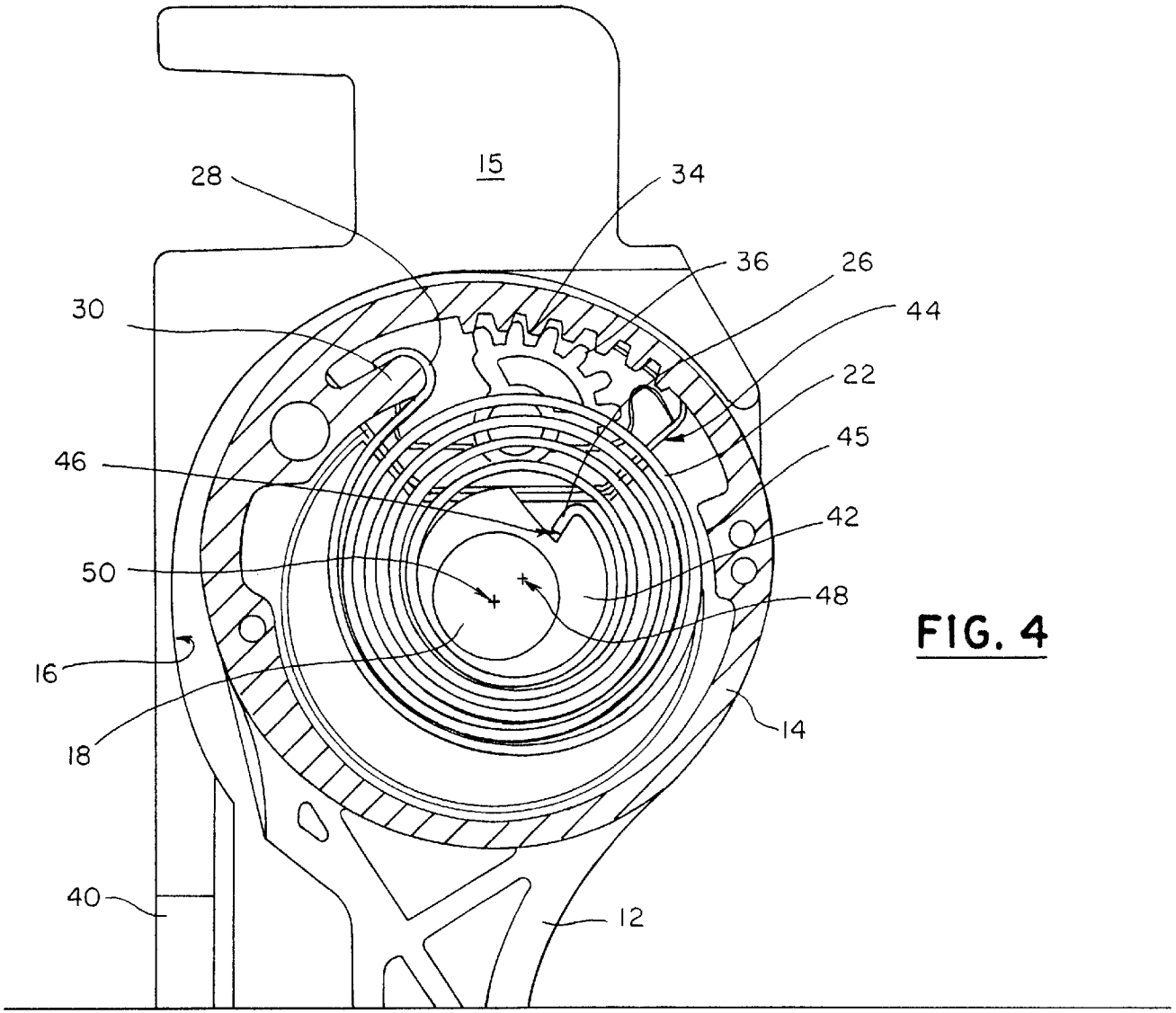
FIG. 4 is a view similar to FIG. 3, but showing the pedal in its partially displaced, actuated position.
Figure 6:
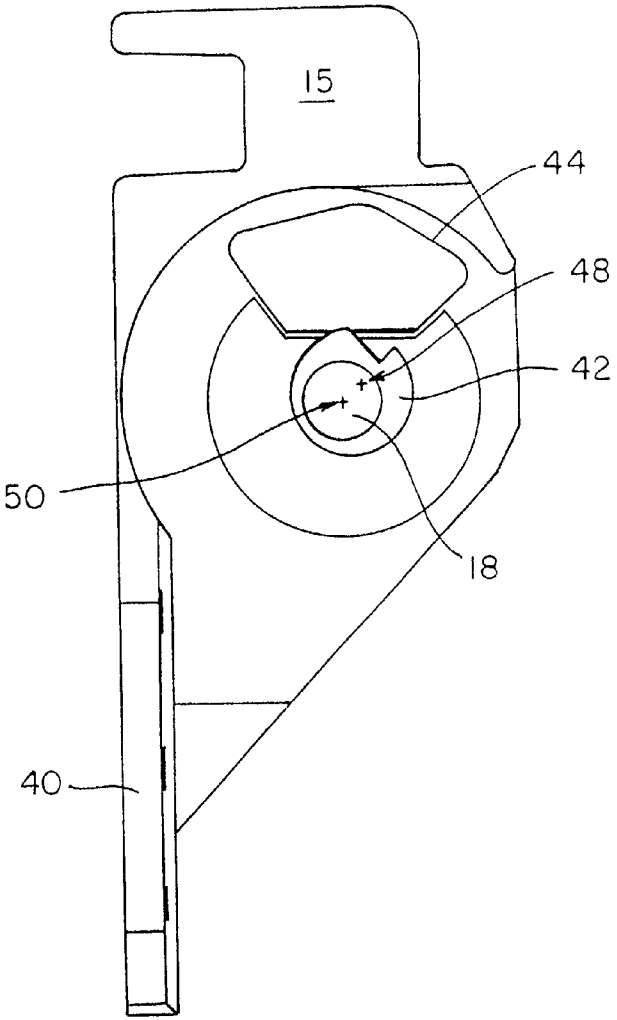
FIG. 6 is a view similar to FIG. 3, the spring and pedal arm having been removed for clarity.

Attention is now directed to FIGS. 3, 4 and 6 which depict an alternative embodiment of the present invention. In this alternative embodiment, a somewhat different form of a spring perch 42 is provided, also having a notch or cutout 46 therein. Spring perch 42 is somewhat larger in diameter than the spring perch 20 previously discussed and has its longitudinal axis 48 laterally offset from the longitudinal axis 50 of the shaft 18 such that the spring perch 42 is mounted eccentric relative to shaft 18. This lateral offset of the spring perch axis 48 relative to the shaft axis 50 is in the direction of the lateral shift of the spring 22 during its loading. As a result of this eccentric mounting arrangement, loading of this spring 22 during displacement of the pedal lever 12 produces little or no lateral displacement of the spring 22. To the extent that some slight lateral displacement of the spring 22 may nevertheless result, the rib 45 may be employed as a stop to limit spring displacement, however in some applications, the optional use of the rib 45 may not be necessary.

From the foregoing, it is apparent that the return spring mounting arrangement and related control lever construction not only provide for the reliable accomplishment of the objects of the invention but do so in a particularly effective and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. In an control lever arrangement comprising a shaft, a spring perch fixed upon the shaft, a control lever pivotally mounted on the shaft, and a spiral spring disposed around the shaft, the spring having an outer end connected to the lever an inner end seated on the spring perch, the improvement wherein the spring perch has an outer surface which is eccentric with respect to the shaft to reduce contact under load between adjacent coils of said spring when the lever is pivoted.

2. The control lever arrangement of claim 1, wherein said perch is a body surrounding said shaft and having a cylindrical outer surface, and has a notch in said outer surface of said body for capturing said inner end of said spring therein.

3. The control lever arrangement of claim 2, wherein the longitudinal axes of said body and said shaft are offset with respect to one another.

4. The control lever arrangement of claim 2, further including a housing having a recess in an inside face thereof, said outer end of said spring being seated in said recess.

* * * * *